US008011995B1

(12) United States Patent
Todd

(10) Patent No.: US 8,011,995 B1
(45) Date of Patent: Sep. 6, 2011

(54) ELECTROMAGNETIC ACTION TOY SYSTEM

(76) Inventor: William M. Todd, Tullahoma, TN (US)

( * ) Notice: Subject to any disclaimer, the term of this patent is extended or adjusted under 35 U.S.C. 154(b) by 1160 days.

(21) Appl. No.: 11/518,714

(22) Filed: Sep. 11, 2006

Related U.S. Application Data

(60) Provisional application No. 60/716,332, filed on Sep. 12, 2005.

(51) Int. Cl.
*A63H 21/00* (2006.01)

(52) U.S. Cl. ..... 446/446

(58) Field of Classification Search ..... 446/446, 446/441, 443–445, 455, 131; 238/10 R; 104/281

See application file for complete search history.

(56) References Cited

U.S. PATENT DOCUMENTS

| | | | | |
|---|---|---|---|---|
| 3,927,620 | A | 12/1975 | Clapham | |
| 4,187,453 | A | 2/1980 | Rough | |
| 4,349,196 | A | 9/1982 | Smith, III et al. | |
| 4,641,065 | A * | 2/1987 | Shibuki et al. | 318/135 |
| 4,878,876 | A * | 11/1989 | Ishimoto | 446/446 |
| 5,605,100 | A * | 2/1997 | Morris et al. | 104/284 |
| 5,782,186 | A | 7/1998 | McTaggart | |
| 5,865,661 | A | 2/1999 | Cyrus et al. | |
| 5,874,881 | A | 2/1999 | Steinbusch | |
| 5,994,798 | A | 11/1999 | Chitayat | |
| 6,011,389 | A | 1/2000 | Masreliez | |
| 6,417,584 | B1 | 7/2002 | Chitayat | |
| 6,713,902 | B2 | 3/2004 | Chitayat | |
| 6,758,146 | B2 | 7/2004 | Post | |
| 6,784,572 | B1 | 8/2004 | Backman et al. | |
| 6,803,681 | B2 | 10/2004 | Faizullabhoy et al. | |
| 7,096,794 | B2 * | 8/2006 | Post | 104/281 |
| 7,387,559 | B2 * | 6/2008 | Sanchez-Castro et al. | 446/444 |
| 2006/0005735 | A1 | 1/2006 | Lopatinsky et al. | |
| 2007/0283841 | A1 | 12/2007 | Lopatinsky et al. | |
| 2008/0011184 | A1 | 1/2008 | Lopatinsky et al. | |

* cited by examiner

*Primary Examiner* — Gene Kim
*Assistant Examiner* — Amir Klayman
(74) *Attorney, Agent, or Firm* — Nixon Peabody LLP

(57) ABSTRACT

The present invention is typically configured as toy racecars and tracks, or model train sets but other toy and non-toy configurations are possible. It has a power supply, controller, track, and moveable object(s) such as a racecar or train. The moveable object(s) is a permanent magnet, or contains one or more permanent magnets, or one or more electrical conductors acting as electromagnets, positioned so as to travel general parallel to the surface of the track. The controller has operator interfaces such as switches and/or a potentiometer(s) for speed/motion input. The track is preferably one or more printed circuit boards with conductive traces configured such that the controller can power them. Current passes through the traces in a repetitive sequential order that causes the magnet/moveable object to be propelled along the track due to the Lorentz force generated by the electromagnetic field(s) acting on the conducting traces and the magnet(s).

10 Claims, 11 Drawing Sheets

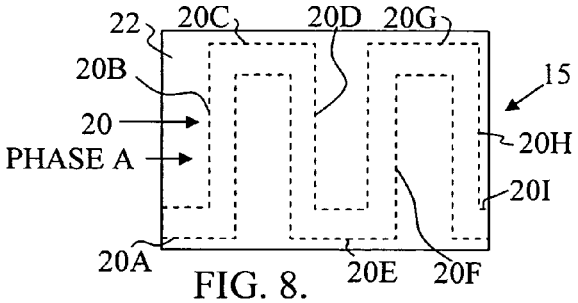
FIG. 8.
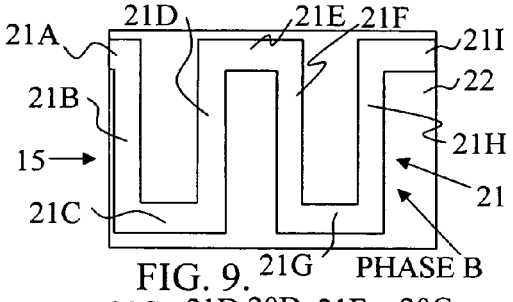
FIG. 9.
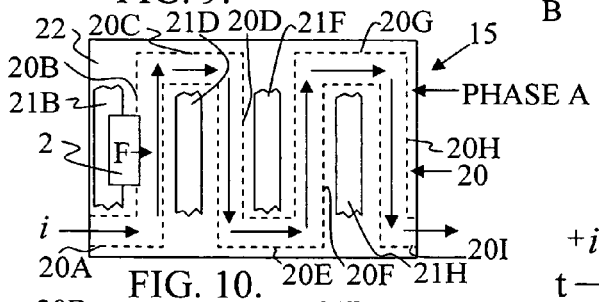
FIG. 10.
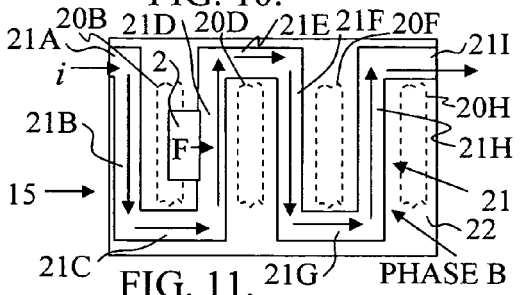
FIG. 11.
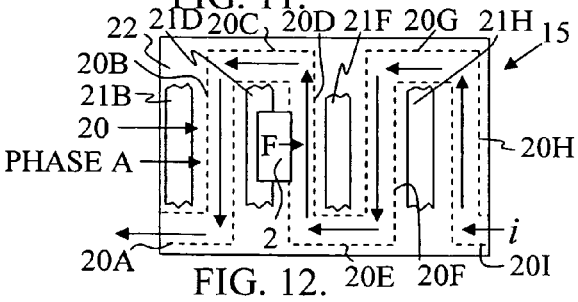
FIG. 12.
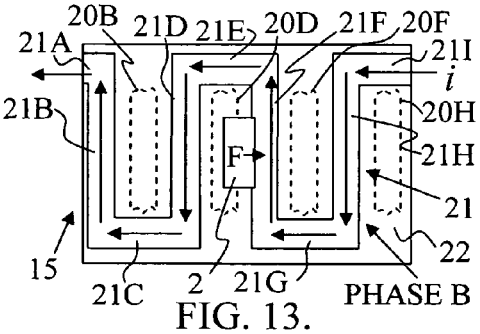
FIG. 13.
AMPLIFIERS' SWITCHING SEQUENCES
| PHASE | CURRENT | FIG. | TIME |
|---|---|---|---|
| A | 20A → 20I | 10 & 15 | $t_1$ |
| B | 21A → 21I | 11 & 16 | $t_2$ |
| A | 20A ← 20I | 12 & 15 | $t_3$ |
| B | 21A ← 21I | 13 & 16 | $t_4$ |
FIG. 14.
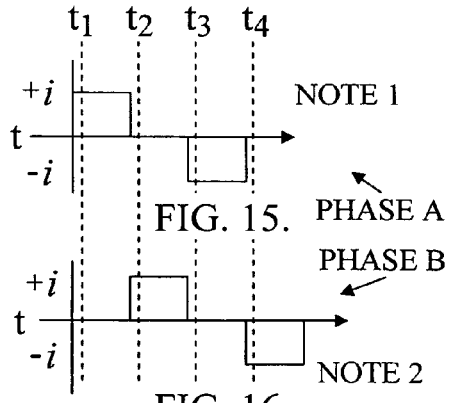
FIG. 15.
FIG. 16.
NOTE 1: CURRENT FLOW FROM 20A TO 20I
NOTE 2: CURRENT FLOW FROM 21A TO 21I

ELECTROMAGNETIC ACTION TOY SYSTEM

CROSS-REFERENCE TO RELATED APPLICATION

This application claims the benefit of U.S. Provisional Application No. 60/716,332, filed Sep. 12, 2005, which is hereby incorporated by reference in its entirety.

FIELD OF THE INVENTION

The present invention relates generally to the field of amusement devices. The present invention relates more particularly to electrical toy action games such as racecar sets, train sets and others producing controlled movement of an object such as a racecar along a fixed or configurable track.

The present invention also relates to electric motors and actuator devices such as linear motors and printed circuit motors.

BACKGROUND OF THE INVENTION

Typical slot car racing games use miniature model cars driven by an electric motor and gears inside them to rotate the drive wheels and tires. Electrical power is provided to the motor via brushes, sometimes called pick-up shoes, attached to the bottoms of the racecars that must drag on electrically energized conductive strips, sometimes called metal track rails, attached to the racetrack and connected to the controller/power supply. All of the components in the racecar wear amazingly fast and must be replaced often. In addition, the required number of components limits the miniaturization of the racecar and therefore the track. Another persistent problem is the accumulation of dirt, oxidation, and debris on the conductive strips of the track and on the racecar brushes, which interrupt the power supplied to the motor. This causes the racecar to move erratically or even stall. Cleaning these items can be a tedious and time-consuming operation to someone (especially a child) that just wants to play a game.

One system has been proposed to overcome some of these problems, but with extreme trade-offs. It uses a non-powered racecar that receives a "kick" from one or more spinning wheels affixed to a single location on the track powered by an electric motor. The wheel(s) spin at a high rpm and accelerate any car that engages the wheel(s). The car then coasts around the track until it reaches the spinning wheel(s) again. The operator may control the rpm of the spinning wheel(s) but has no control of the racecar speed except at the one point in the track where the car engages the spinning wheel(s).

Linear motors are used for industrial systems and magnetic levitation (maglev) trains. These devices are complex and far too expensive for use in toy systems. The linear motors contain coils of copper wire with ferrous cores distributed along the track, or even permanent magnets distributed along the track, or the moveable object itself has coils that must be electrically powered. Also the position of the moveable object must be continuously sensed with sophisticated instrumentation and fed back to the controller for proper operation.

SUMMARY OF THE INVENTION

It is a primary object of the present invention to provide an improved and low-cost miniature action toy.

Another related object is to provide such an improved toy that overcomes the limitations and shortcomings of existing similar toys.

Other objects and advantages of the invention will be apparent from the following detailed description and the accompanying drawings.

In accordance with the present invention, the foregoing objectives are realized by providing a system comprised of an electrical power supply, control system, track, and moveable object(s) such as a racecar or train.

The electrical power supply may be either batteries or a modular power supply plugged into house power or even automobile power such as from a cigarette lighter socket.

The control system is preferably microcomputer based with an operator interface containing a potentiometer for speed/motion control by the operator. The microcomputer primarily functions as a variable frequency multi-phase oscillator to provide control signal outputs to the switching amplifier circuitry, such as H-Bridges. The amplifiers in-turn supply power from a current regulator to the track. The microcomputer varies the output frequency based on the operator's positioning of the trigger attached to the potentiometer in the operator interface. Other functions of the microcomputer will be detailed later.

The track is preferably a printed circuit board (PC board or PCB), also known as a printed wiring board (PWB), with its conductive traces configured such that they can be sequentially powered. The control system passes electrical current through the printed circuit traces, typically in a repetitive sequential order that causes the magnet, and thus the attached moveable object, to be propelled along the track due to the Lorentz force generated by the electromagnetic field acting on the conductor (printed circuit traces) and the magnet. The printed circuit track may be composed of a typical copper-clad non-conductive substrate and be single-sided, double-sided, or multi-layer and may be produced by the typical chemical etching processes. Alternately, the conductive layers may be die-cut and assembled between non-conductive substrate layers, or the traces may be printed on a non-conductive substrate with conductive ink and then assembled in layers. Ground plane layers may be added above and below the trace layers to reduce emissions. Alternately, the conductors may be wires affixed to a track in patterns to give the same effect as the printed circuit. More than one lane may be on a single track to accommodate more than one moveable object. Each lane would have its own operator interface although portions of the controller and power supply may be shared. Since the magnet of the moveable object always attempts to cross the printed circuit traces at a 90-degree angle the moveable object tries to follow the track even around corners however, inertia will push it out of its lane in the corners if it is going very fast so guardrails may be used for each lane to allow higher speeds. Electrical current carrying printed circuit traces may also be used as Lorentz force "guard rail" barriers on either or both sides of each lane along the track. As the moveable object approaches this trace, it will be repelled and pushed back toward the center of the lane. The printed circuit track may be flexible or rigid. Flexible printed circuit boards allow the racecar to bank, pass over other parts of the track (as for a figure eight), or even race around a vertical loop. The track may also have jump ramps, moguls, or even "half pipes" as in skate parks. The track may be a single printed circuit board or be numerous pieces of various shapes to allow configuration by the operator. Areas of a single board track, or individual or groups of track pieces, may be electrically bypassed, when the moveable object is not present there, in order to reduce overall power consumption and emissions. The printed circuit track is economical to produce and requires modest tooling.

The moveable object such as a racecar is either an electromagnet, permanent magnet, or permanent magnet array, or has at least one electromagnet, permanent magnet, or ferromagnetic material positioned and attached generally flush with the surface(s) of the moveable object adjacent to the track so as to move with the moveable object generally parallel to the surface of the track. The moveable object may also have wheels and axles but they are not required. The moveable object may also be shaped like a human, racehorse, motorcycle, skateboard, boat, airplane, board game pieces, or any other object or animal as desired. The moveable object may also contain electric coils to induce power from the track to power devices in the car such as lights or even motors.

BRIEF DESCRIPTION OF THE DRAWINGS

FIGS. 8 through 13 are plan views of a track configuration with various layers removed for clarity. These figures show the movement of a magnet as the traces are energized as detailed in the table of FIG. 14 and diagrams of FIG. 15 and FIG. 16;

FIG. 29 is a plan view of an interface section for connecting controllers and power to the racetracks;

FIG. 21 is a plan view of a flexible PCB track section in its pre-flexed state. FIG. 22 is an elevation plan view of the same. FIG. 23 is a plan view of the same section after flexure to form a banked curve. FIG. 24 is an elevation view of FIG. 23;

FIG. 31 is an elevation view of a flexible PCB track section configured into a loop. FIG. 30 is a plan view of FIG. 31 and FIG. 32 is a bottom view of the same;

DETAILED DESCRIPTION OF THE ILLUSTRATED EMBODIMENTS

Figure 1:
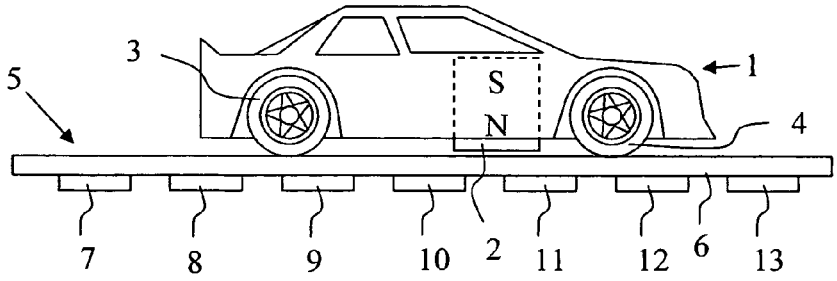
FIG. 1 is a side elevation of a model racecar containing a permanent magnet positioned on top of a track that includes a single-sided printed circuit board ("PCB")

While the invention is susceptible to various modifications and alternate forms, specific embodiments thereof have been shown by way of examples in the drawings and will be described in detail. It should be understood, however, that they are not intended to limit the invention to the particular forms described, but on the contrary, the intention is to cover all modifications, equivalents, and alternatives falling within the spirit and scope of the invention.

Figure 2:
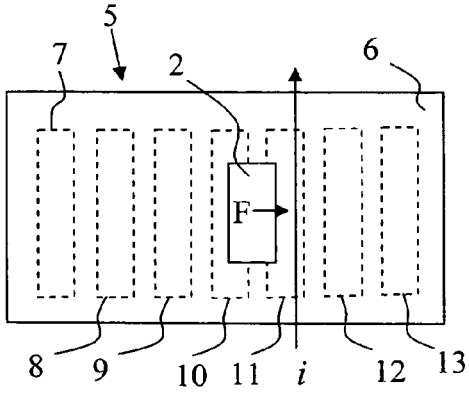
FIGS. 2 through 5 are plan views of the track of FIG. 1 with the racecar removed for clarity but retaining the magnet, illustrating the movement of the magnet as various traces of the PCB are energized.

Turning now to the drawings, FIG. 1 is a side elevation of a short section of track 5 comprised of a thin single-sided printed circuit board (PCB) with small rectangular copper traces, such as trace segments 7 through 13, remaining on the lower surface of the nonconductive glass cloth/epoxy NEMA grade FR-4 substrate 6 after the typical masking and etching process used for making printed circuit boards for the electronics industry. A moveable object shaped as a miniature model racecar 1, with optional wheels such as 3 and 4, rests on the top surface of the track 5. The racecar 1 is made of non-ferrous and non-magnetic plastic but contains a permanent magnet 2 with its north pole in close proximity to the top surface of the track 5. FIG. 2 is a top plan view the track 5 and the magnet 2, with the racecar 1 removed for clarity. Using the positive convention for electric flow, as an electrical current i is passed through trace segment 11, an electromagnetic field is generated around the trace segment 11. This electromagnetic field interacts with the magnetic field of the permanent magnet 2 to produce an electromagnetic force called the Lorentz Force that causes an attractive or repulsive force between the conducting trace segment 11 and the magnet 2. The general direction of the force can be determined by the right-hand rule for force. If the magnitude of the current i is sufficient, the magnet 2 will accelerate generally in the direction shown by the arrow F.

Figure 3:
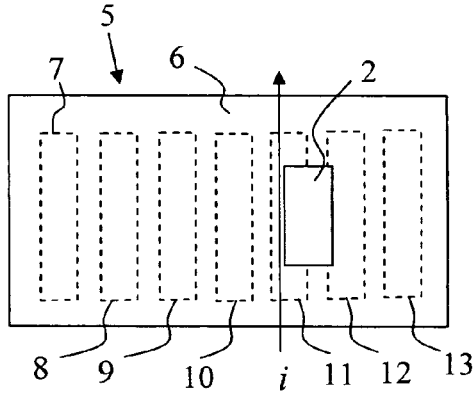

In FIG. 3 the magnet 2 has decelerated and stopped in the general position shown while the current i is still flowing through the trace segment 11. The overall motion of the magnet 2 depicted in FIGS. 2 and 3 is one increment of movement of the magnet 2 along the track 5, over the trace segment 11.

Figure 4:
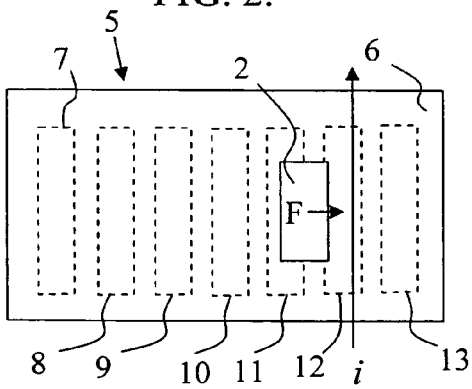

In FIG. 4 the current i has been removed from trace segment 11 and applied to trace segment 12. The process starts again, and the magnet 2 traverses the trace segment 12 and stops in the general position shown in FIG. 5.

Figure 5:
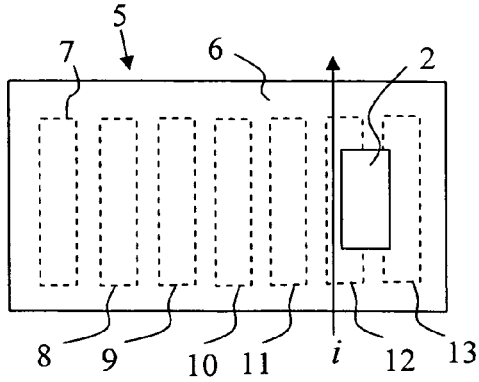

Although not utilized in this embodiment, it should be noted that if the direction of the current i shown in FIGS. 3 and 5 is reversed, the direction of the force is also reversed, according to the right-hand rule. Similarly, if the magnet were inverted so that the south pole was adjacent to the surface, the direction of the force would again be reversed, according to the right-hand rule.

Now if we imagine a much longer track with many more trace segments, and the current is then applied to these segments one at a time sequentially, the magnet will continue to move along the track. As the current is moved from one trace segment to the next at a faster and faster pace, the motion of the magnet will smooth out because the attractive force of the subsequent trace segment will occur before the magnet comes to a complete stop at the end of its traversing movement over the previous trace segment.

Figure 6:
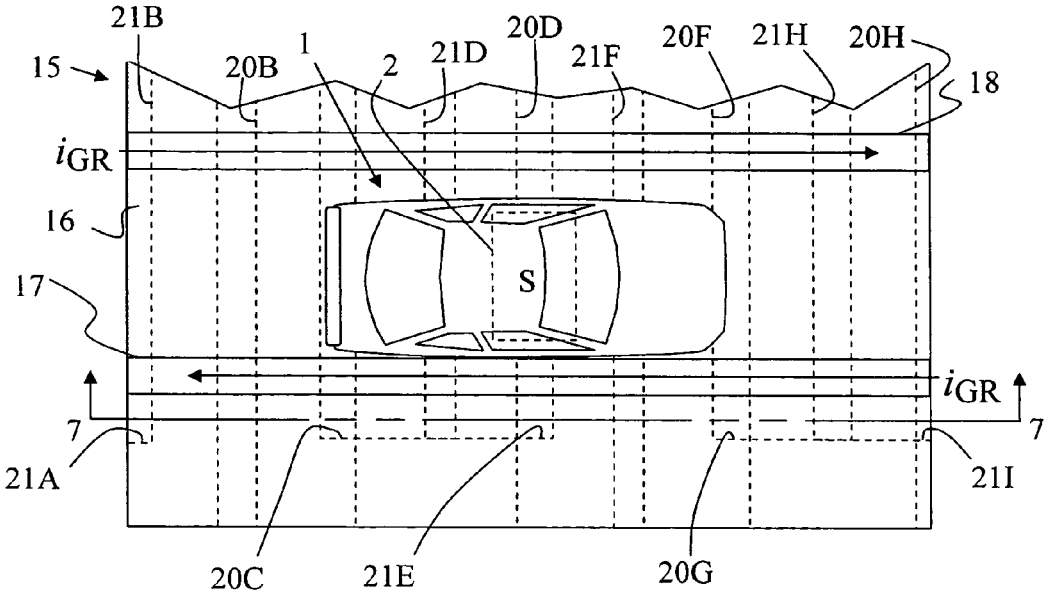
FIG. 6 is a partial plan view of a multi-layered PCB track configuration having guardrails on the track surface. The FIG. 7 is a cross-section of FIG. 6.
Figure 7:
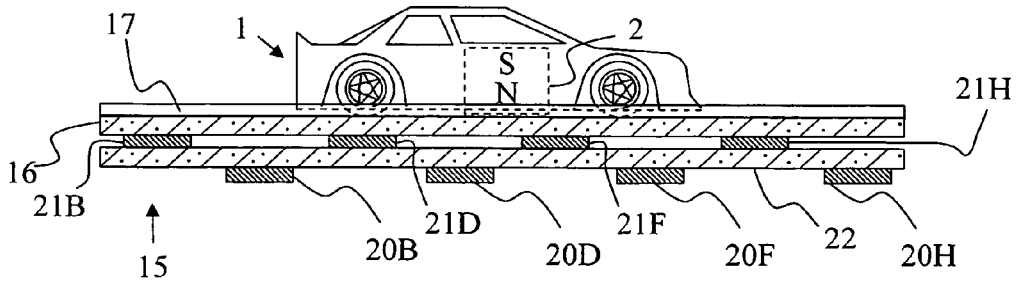

The above descriptions and FIGS. 2-5 illustrate the general principle of operation, but it is not economically practical to build a controller capable of powering each trace segment individually. FIG. 6 through 16 illustrate an embodiment that avoids the need for the controller to individually power each trace segment. In FIGS. 6 and 7, a multi-layer PCB track 15 has a racecar 1 on the top surface of the track. FIG. 8 is a plan view of the track 15 with the racecar 1, top substrate 16, guardrails 17 and 18, and copper trace 21 removed for clarity. FIGS. 9-13 are plan views of the track 15 with the racecar 1, top substrate 16, and guardrails 17 and 18 removed for clarity. The magnet 2 has been repositioned as shown. The copper trace 20, labeled PHASE A, resides on the upper surface of substrate 22 and begins at trace segment 20A and ends at trace segment 20I. The trace 20, or PHASE A, is comprised of trace segments 20A, 20B, 20C, 20D, 20E, 20F, 20G, 20H, and 20I. FIG. 9 clearly shows the copper trace 21, labeled PHASE B, comprised of trace segments 21A, 21B, 21C, 21D, 21E, 21F, 20G, 21H, and 21I, which resides on the lower surface of substrate 22. The trace 21 PHASE B has a similar construction but its position is shifted on the substrate 22 with respect to trace 20 PHASE A as shown. And now it will be described with the switching sequences depicted in the table of FIG. 14, the timing diagrams of FIGS. 15 and 16, the handheld controller 180 in FIG. 33, the power supply 190 in FIG. 34, the block diagram 200 in FIG. 35, and the flow chart 220 in FIG. 36 how this embodiment will move the magnet 2 along the track 15, as shown in FIGS. 10-13.

Figure 33:
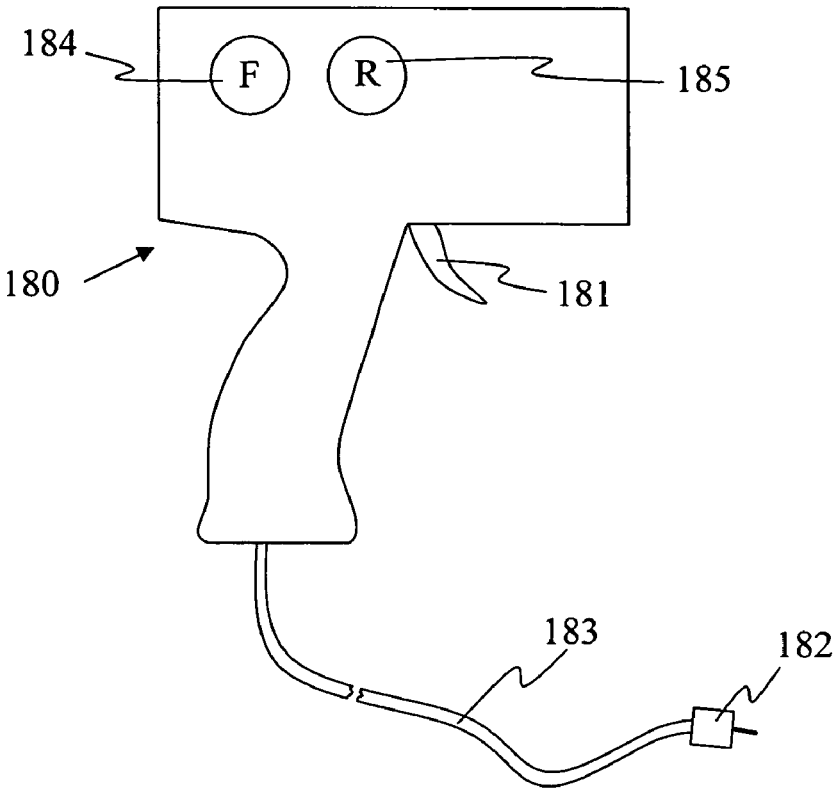
FIG. 33 is an elevation view of a handheld operator interface showing the potentiometer trigger lever speed controller and interface cable with connector.
Figure 35:
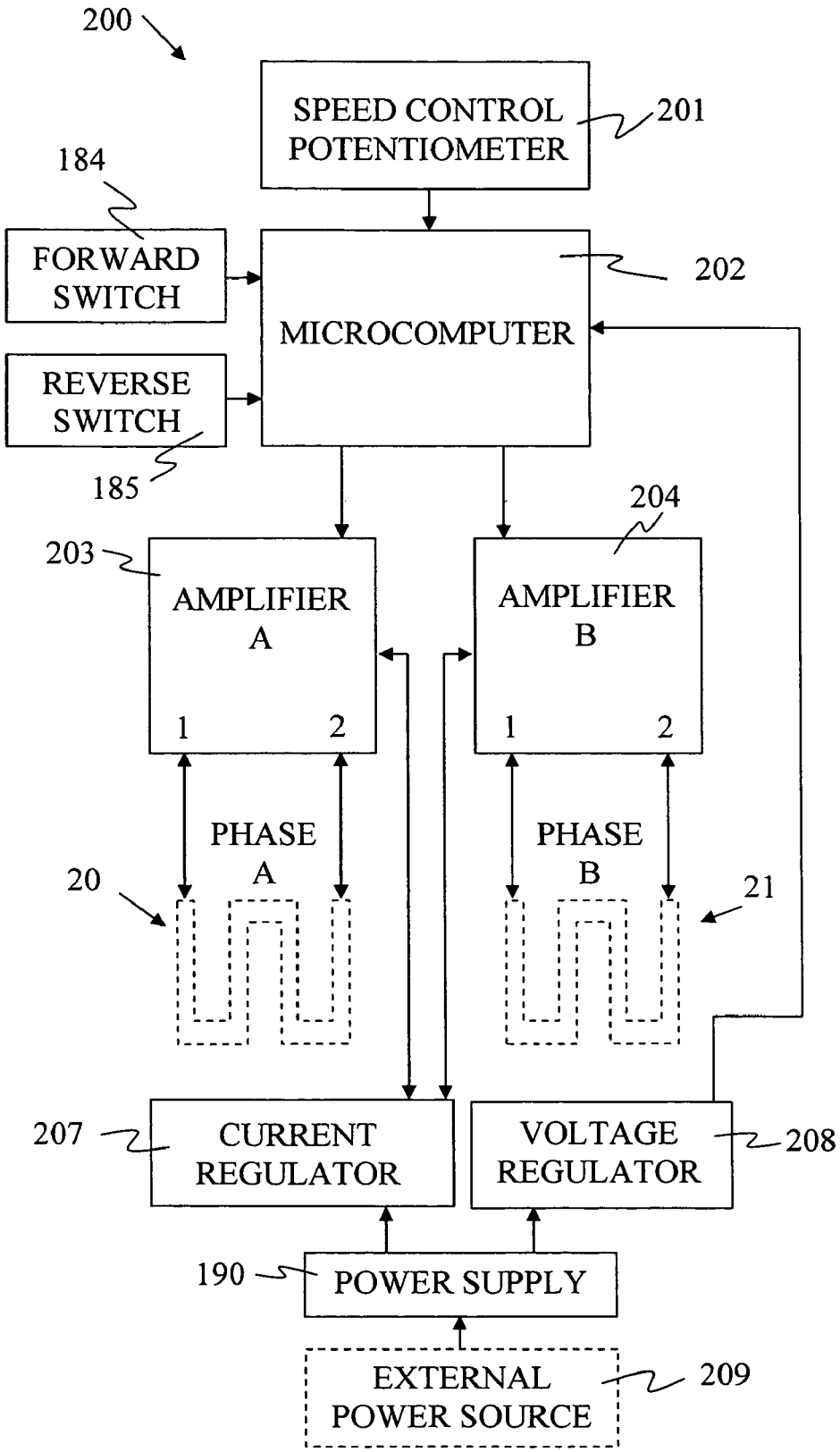
FIG. 35 is a block diagram of a typical embodiment of an electronic control unit for an embodiment utilizing a microcomputer and switching amplifiers.

Referring to FIG. 33, a tough plastic, such as ABS (Acrylonitrile, Butadene, and Styrene) conforming to UL94V flammability rating, is molded into the pistol-grip style handheld controller 180 as shown. It internally contains a printed circuit board assembly that has the following components, as depicted in FIG. 35; speed control potentiometer 201 (such as a 5K Ohm, Single Turn, B taper, Bourns Inc. part number 3310C-001-502, available from Digi-Key Corporation, 701 Brooks Avenue South, Thief River Falls, Minn., 56701), microcomputer 202 (such as part number PIC16F819-I/P available from Microchip Technology Incorporated, 2355 West Chandler Blvd., Chandler, Ariz., USA 85224-6199), amplifier A 203 (such as an H-Bridge amplifier circuit composed of two ST Microelectronics Darlington pair transistors, part number MJD112T4 for the H-Bridge low legs, and two ON Semiconductor silicon controlled rectifiers part number MCR22-6RLRA, driven by Lite-On Incorporated optoisolators part number LTV-847, for the H-Bridge high legs, all also available from Digi-Key), amplifier B 204 (the components are identical to amplifier A), current regulator 207 (such as a National Semiconductor Incorporated part number LM2676T-ADJ, also available from Digi-Key), and voltage regulator 208 (such as a National Semiconductor Incorporated part number LM2574N-5.0, also available from Digi-Key). The trigger 181 is attached to the speed control potentiometer 201 of FIG. 35. The cable 183 and connector 182 are used to connect the controller 180 to tracks as described later. The forward and reverse direction switches F 184 and R 185 on the controller 180 of FIG. 33 are also depicted on FIG. 35.

Figure 34:
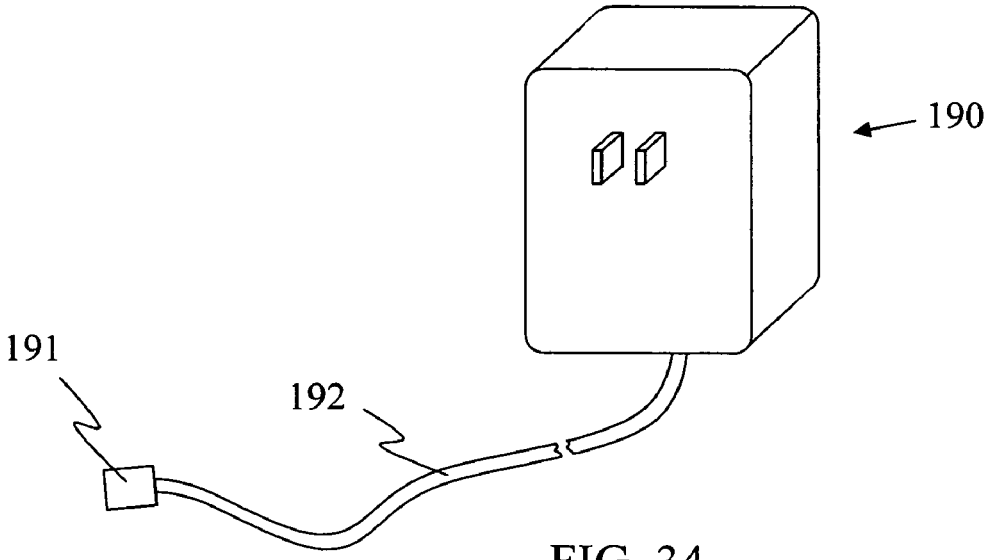
FIG. 34 is a perspective view of a typical modular power supply.

The power supply 190 (such as a Cincon Electronics Co., Ltd part number TR70A2402A03, available from Mouser Electronics, Incorporated, 1000 North Main Street, Mansfield, Tex. 76063), shown in FIG. 34 and also FIG. 35. The cable 192 and connector 191 are used to connect it to tracks as explained later. It is powered by typical household 110 volts AC electrical power as depicted by block 209 of FIG. 35

For the following explanation a forward direction is assumed which means the F switch 184 of FIG. 33 has been selected by the operator. Now referring first to the flow chart 220 in FIG. 36, the microcomputer 202, shown in FIG. 35, begins performing the software instructions, programmed into its flash memory, at the start block 221. It proceeds to block 223 where it reads the voltage across the speed control potentiometer 201, shown in FIG. 35. If the read voltage is zero, this indicates that the operator is not squeezing the trigger 181 of FIG. 33, which is attached to the potentiometer 201 of FIG. 35. As long as the voltage remains zero, a decision is made in block 224 of FIG. 36 to loop back to block 223.

The operator has now decided to move the magnet 2 of FIG. 10 so he squeezes the trigger 181 of FIG. 33 which in-turn rotates the potentiometer 201 of FIG. 35. A voltage will develop across the potentiometer 201 of FIG. 35 proportional to the amount the potentiometer is rotated. The next time the microcomputer 202 loops through the block 223 of FIG. 36 this voltage will be read. The flow will again proceed to block 224 but this time the voltage will not be zero so the flow will proceed to block 225. The microcomputer 202 will now use a voltage versus switching delay value look-up table stored in its flash memory and represented by block 226 to find a corresponding switching delay value that will produce the amplifiers' A 203 and B 204 of FIG. 35, switching frequency required to achieve the operator's requested speed for the magnet 2. The flow now proceeds to block 227 of FIG. 36 where the microcomputer references the amplifiers' switching sequences look-up table represented by block 228. The amplifier A 203 of FIG. 35 is then turned on, step 229 loads the delay value into the delay timer of block 230, and the current i, supplied by the power supply 190 in FIGS. 34 and 35, is regulated by the current regulator 207 of FIG. 35 and flows as follows: Referring now to FIGS. 10, 14, 15, 16, and 35, the electrical current i applied at time $t_1$ to trace segment 20A flows through the trace 20 PHASE A, as indicated by the arrows, and exits at trace segment 20I. The resulting electromagnetic force F of FIG. 10 moves the magnet 2 to the position shown in FIG. 11.

Figure 36:
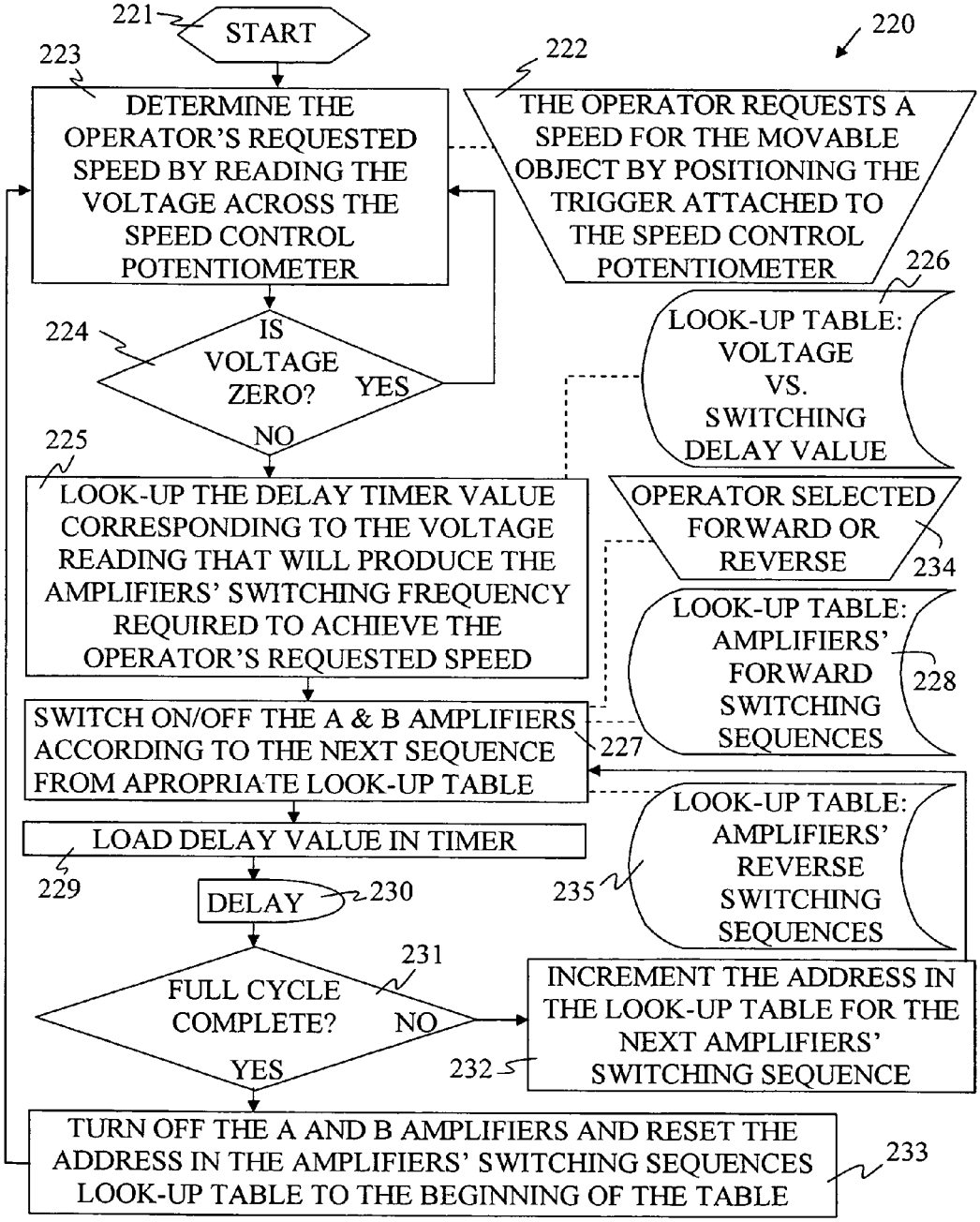
FIG. 36 is a flow chart representing the algorithm of the electronic control unit.
Figure 37:
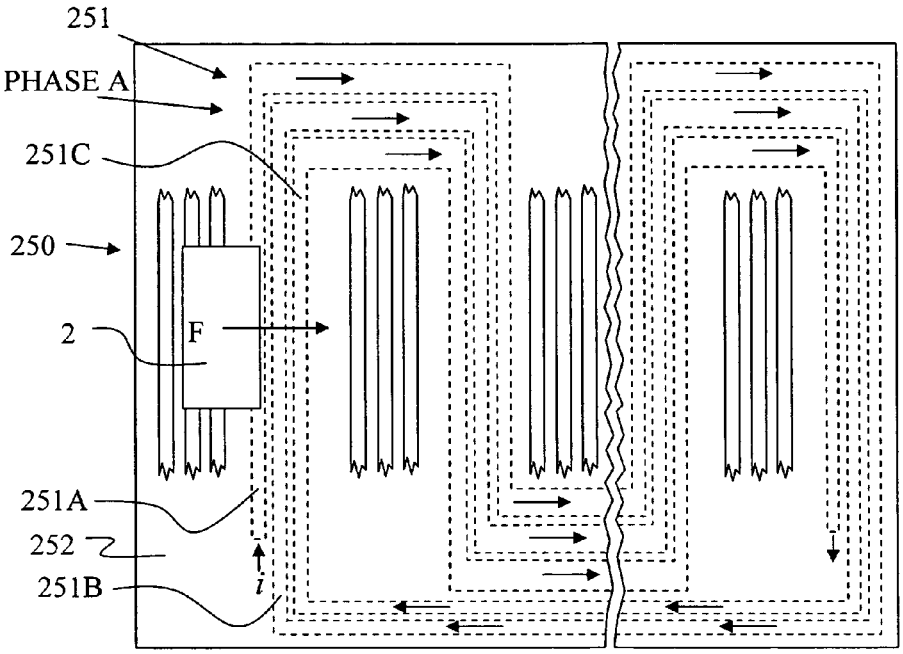
FIGS. 37 and 38 are another configuration of a multi-layered PCB track depicting narrow traces connected in series to simulate the effects of wider traces but using lower current.
Figure 38:
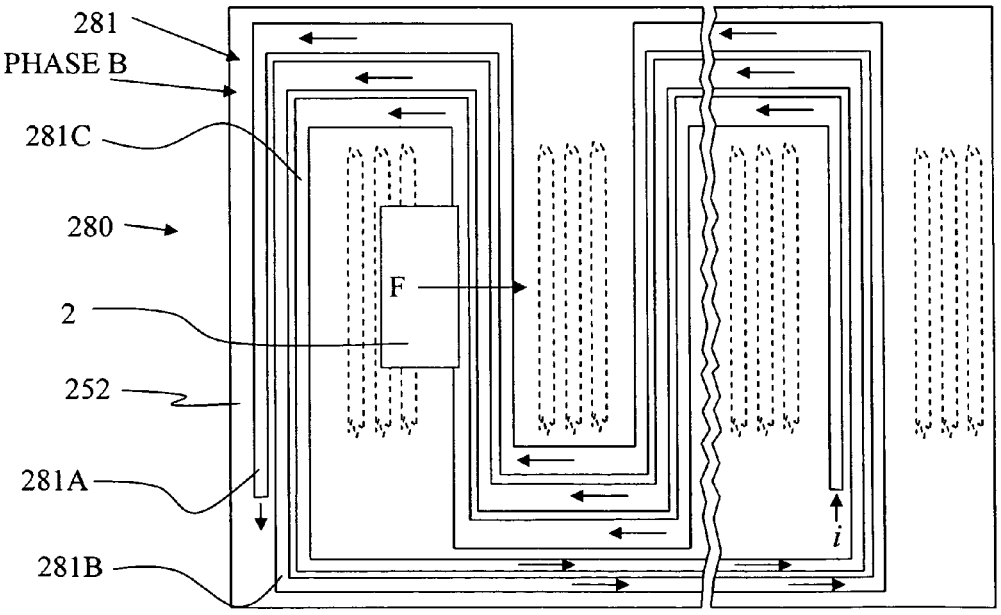

The delay timer of block 230 in FIG. 36 times out and the flow proceeds to the decision block 231 to determine whether the cycle is complete. A cycle is represented by the table of FIG. 14 and the diagrams FIGS. 15 and 16. When decision block 231 determines that the cycle is not complete, the flow proceeds to block 232 of FIG. 36 where the address of the amplifiers' switching sequence look-up table is incremented to the next sequence. The flow loops back to the block 227 where the amplifier A 203 of FIG. 35 is turned off and amplifier B 204 is turned on. The flow proceeds to block 229 where the delay timer is reloaded with the same value looked-up previously.

Now as seen in FIGS. 11, 14, 15, 16, and 35, the current i applied at time $t_2$ to trace segment 21A flows through the trace 21 PHASE B, as indicated by the arrows, and exits at trace segment 21I. The resulting electromagnetic force moves the magnet 2 to the position shown in FIG. 12. The delay timer of block 230 FIG. 36 times out and the flow proceeds to the decision block 231. The cycle, as represented by the table of FIG. 14 and the diagrams FIGS. 15 and 16, is not complete so the flow proceeds to block 232 of FIG. 36 where the address of the amplifiers switching sequence look-up table is incremented to the next sequence. The flow proceeds to block 227 where the amplifier A 203 is turned on in reverse and the amplifier B 204 is turned off according to the next sequence from the look-up table of block 228. The delay timer of block 230 is reloaded with the same value looked-up previously, and the current i, supplied by the power supply 190 in FIGS. 34 and 35, is regulated by the current regulator 207 of FIG. 35 and flows as follows:

Referring now to FIGS. 12, 14, 15, 16, and 35 the electrical current i applied at time $t_3$ to trace segment 20I flows through the trace 20 PHASE A, as indicated by the arrows, and exits at trace segment 20A. The resulting electromagnetic force F of FIG. 12 moves the magnet 2 to the position shown in FIG. 13. The delay timer of block 230 in FIG. 36 times out and the flow proceeds to the decision block 231. The cycle, as represented by the table of FIG. 14 and the diagrams FIGS. 15 and 16, is not complete so the flow proceeds to block 232 of FIG. 36 where the address of the amplifiers switching sequence look-up table is incremented to the next sequence. The flow loops back to the block 227 where the amplifier A 203 of FIG. 35 is turned off and amplifier B 204 is turned on in the reverse direction. The flow proceeds to block 229 where the delay timer is reloaded with the same value looked-up previously.

Referring now to FIGS. 13, 14, 15, 16 and 35, the electrical current i applied at time $t_4$ to trace segment 21I flows through the trace 21 PHASE B, as indicated by the arrows, and exits at trace segment 21A. The resulting electromagnetic force moves the magnet 2 in the direction of the F arrow in FIG. 13 to a new position, not shown, just to the opposite side of the trace segment 21F. The delay 230 of FIG. 36 times out and the flow proceeds to block 231 where according to the table of FIG. 14 and the diagrams of FIGS. 15 and 16, the amplifiers switching sequences have now completed a cycle. The flow proceeds to block 233 of FIG. 36 where the amplifier B 204 is turned off. The amplifiers' switching sequences look-up table address is reset to the beginning of the look-up table and the flow proceeds back to block 223 where the process will start over again.

The magnet will continue along the track if a new cycle occurs beginning at a new time $t_5$ (not shown) that is electrically identical to time $t_1$ of FIGS. 10, 14, 15 and 16. The cycling continues to repeat until the operator releases the trigger 181 of the controller 180 in FIG. 33.

It should be noted, as best seen in FIG. 11, that the magnet 2 is not significantly affected by the current i flowing through trace segments behind it, such as trace segment 21B, because the distance between the magnet 2 and the segment 21B is sufficient that the force between them diminishes to near zero since the magnitude of the force is inversely proportional to the square of the distance between them. This also applies to the lateral trace segments such as segments 21C, 21E, 21G, and 21I. Similarly, this also applies to the trace 20 PHASE A.

It should also be noted that the reverse direction of the magnet 2 is achieved when the operator selects the R switch 185 of FIG. 33, also depicted on FIG. 35. This selection causes the microcomputer 202 to use a look-up table 235 of FIG. 36. This look-up table 235 defines a reverse amplifiers' switching sequence that is basically reversed from the sequence of the forward look-up table 228. This reverse sequence is as if the table of FIG. 14 is followed to complete a reverse cycle starting with time $t_4$ then $t_3$ then $t_2$ and then $t_1$.

Referring again to FIGS. 6 and 7, optional copper traces 17 and 18 located on the upper surface of the upper substrate 16 are used as guardrails. These guardrails are tall enough to impinge against the body of the racecar 1 if the racecar 1 moves far enough from the centerline of its respective lane and therefore help to retain the racecar 1 within its intended path. In addition to serving as physical retention devices, the guardrails 17 and 18 may also have an electromagnetic repulsion effect. If the period of each pulse of FIGS. 15 and 16 is shortened slightly, and a current $i_{GR}$ is passed through the guardrails 17 and 18 during the off-time of each phase, the magnet 2 in the racecar 1 will be repelled by the resulting electromagnetic fields around the guardrails 17 and 18 (according to the right hand rule).

Figure 17:
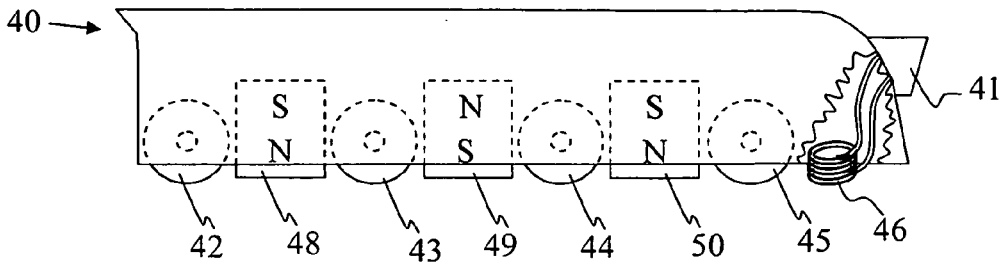
FIG. 17 is an elevation view of a locomotive with magnets and an electrical wire coil.

FIG. 17 is a moveable object in the form of a model locomotive 40 containing a plurality of magnets 48, 49, and 50 for additional power to drive its longer body. The wheels 42, 43, 44, and 45 are optional. An electrical wire coil 46 is connected to a lamp 41. Current is induced in the coil 46 as it passes over current-carrying trace segments. This induced current flows to the lamp 41 to power it.

Figure 18:
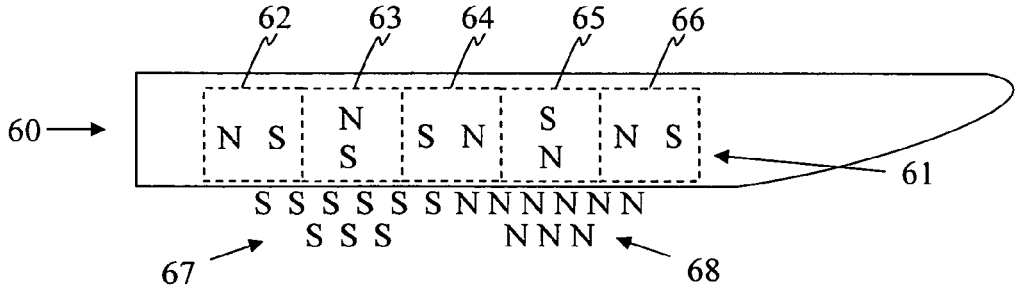
FIG. 18 is an elevation view of a speedboat-style moveable object with magnets in a Halbach array configuration.

FIG. 18 illustrates a moveable object in the form of a model speedboat 60 housing a magnetic array 61 known as a Halbach Array composed of magnets 62, 63, 64, 65, and 66. The Halbach Array concentrates its magnetic flux 67 and 68 on a single surface of the array, in this case the bottom surface. This property reduces the attractive and repulsive forces between moveable objects in different lanes on the same track while concentrating the flux toward the track where it is required.

Figure 19:
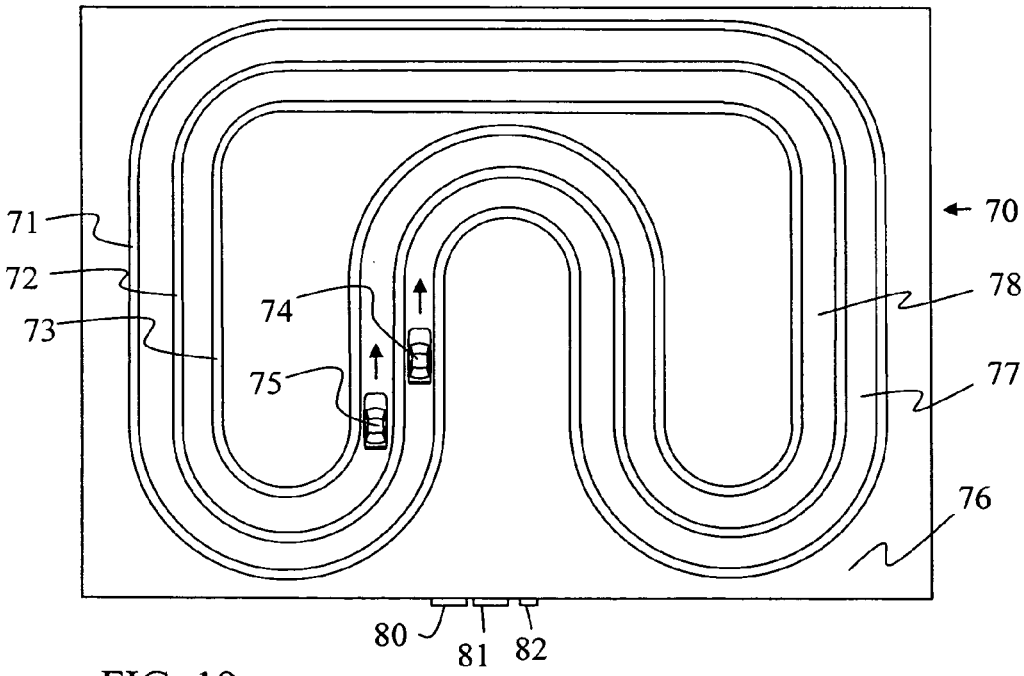
FIG. 19 is a plan view of a single board fixed configuration racetrack.
Figure 20:
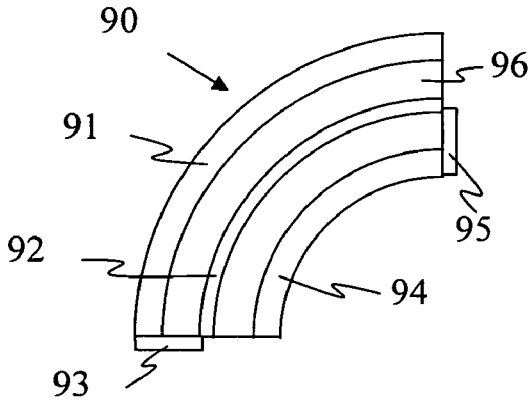
FIGS. 20 through 32 are various views of track sections for user-configurable racetracks.

FIG. 19 is a plan view of a two-lane fixed configuration racetrack 70 laid out on a single PCB 76. Multiple connectors 80, 81, and 82 are used to connect controllers (see FIG. 33) and a power supply (see FIG. 34). The racecar 74 travels in the lane 77, and the racecar 75 travels in the lane 78. Each of these lanes 77 and 78 contains copper traces (not shown) that are configured and function just as those previously described for the track 15 of FIGS. 6, 7, 8, 9, 10, 11, 12, and 13. The guardrails 71, 72, and 73 of FIG. 19 are composed of a thin layer of the FR-4 PCB substrate material attached to the surface of the PCB 76 to help retain the racecars 74 and 75 on the track 70.

Figure 24:
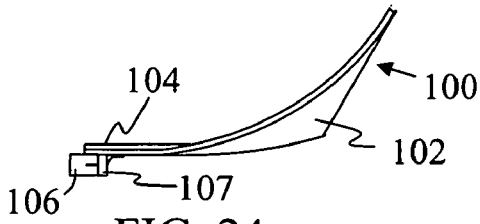
Figure 25:
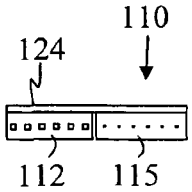
Figure 26:
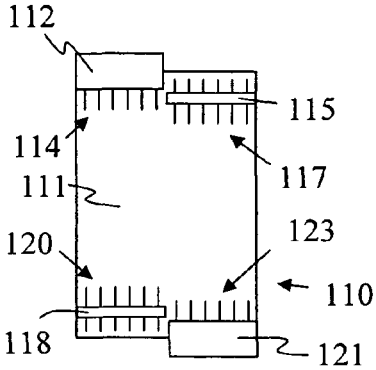
Figure 27:
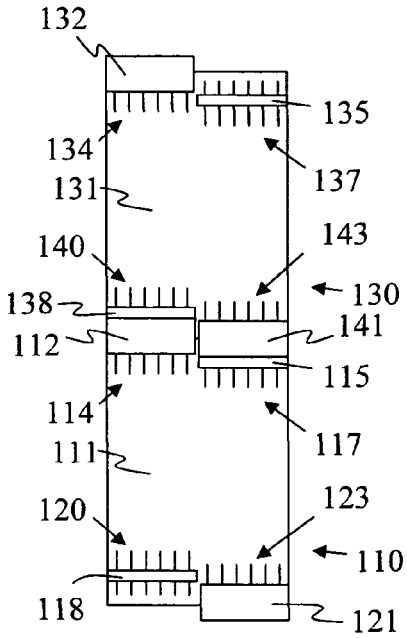
Figure 28:
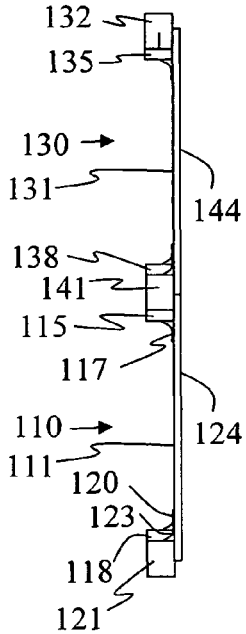
Figure 29:
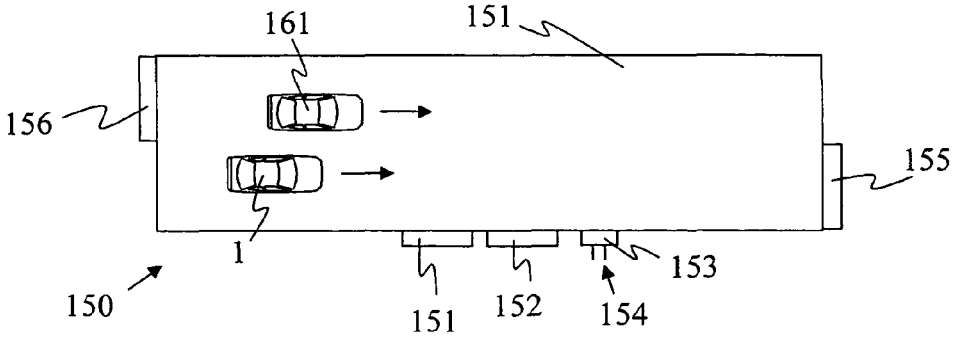
Figure 30:
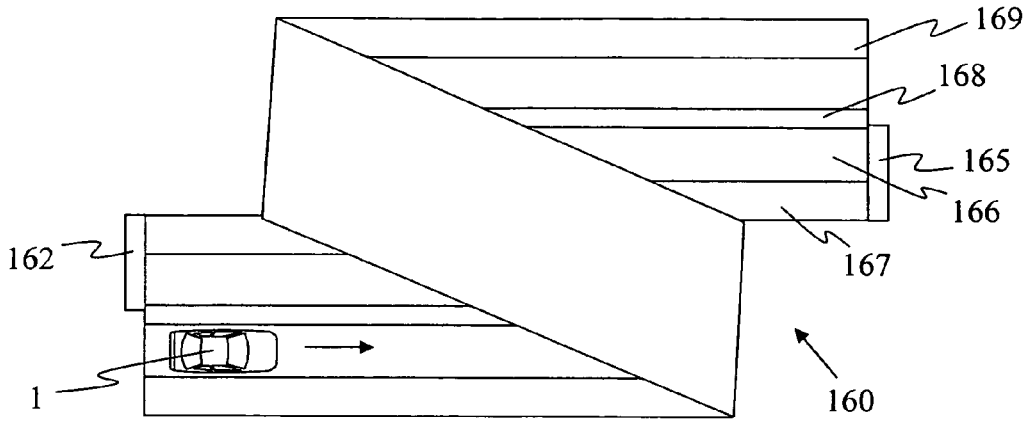

FIGS. 20 through 32 are examples of sections of user-configurable tracks. FIG. 26 is a bottom plan view of a short section of straight track 110. FIG. 25 is an end elevation view of the same track section 110. All of the aforementioned user-configurable track sections use male connectors such as connector 115 (e.g., part number 22-28-8060 available from Molex/Waldom Electronics Corporation, 2222 Wellington Court, Lisle, Ill. 60532-1682), shown clearly in FIGS. 25 and 26. The connectors 115 mate with female connectors such as connector 112 (e.g., part number PPTC061LGBN available from Sullins Electronics Incorporated, 801 E. Mission Road, San Marcos, Calif., 92069). The solder contacts such as 114 and 117 of these connectors are formed as shown and surface mount soldered to the traces on printed circuit board tracks, such as the track 110 in FIG. 26. They provide electrical and mechanical connections between adjacent track sections, as can be seen in FIG. 27 where two track sections 110 and 130 (shown from the bottom) are connected together via female connector 112 mated to male connector 138 and male connector 115 mated to female connector 141. FIG. 28 is a side elevation view of the same track sections 110 and 130. FIG. 29 is a plan view of an interface section of racetrack. One is required per racetrack to allow connection of controllers, such as the controller of FIG. 33, and a power supply, such as the power supply of FIG. 34. It should be noted that the straight sections of track do not necessarily require guardrails for proper operation.

Figure 21:
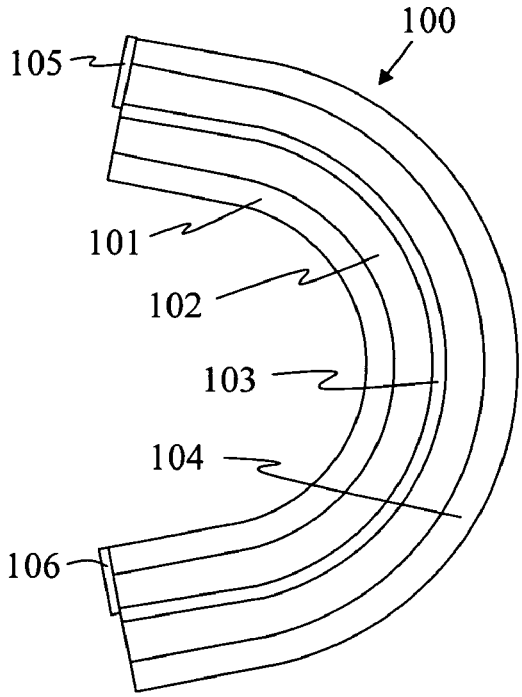
Figure 23:
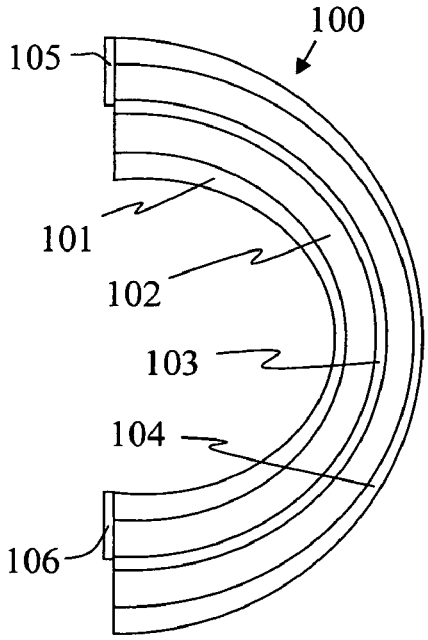
Figure 22:
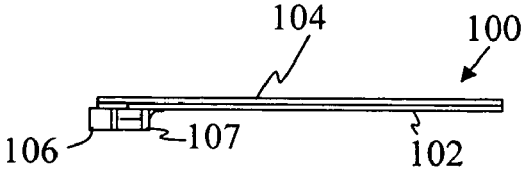

FIG. 21 is a plan view of a PCB track banked-curve section 100 in its pre-flexed/pre-banked state. The track sections are only about 0.025" thick FR-4 material. This material is very durable and flexible at this thickness. FIG. 22 is an elevation view of the same. FIGS. 23 and 24 are plan and elevation views of the same section 100 after flexure to form the banked curve. The flexible-PCB, banked-curve section 100 mates with the other user-configurable track sections as previously described.

Figure 31:
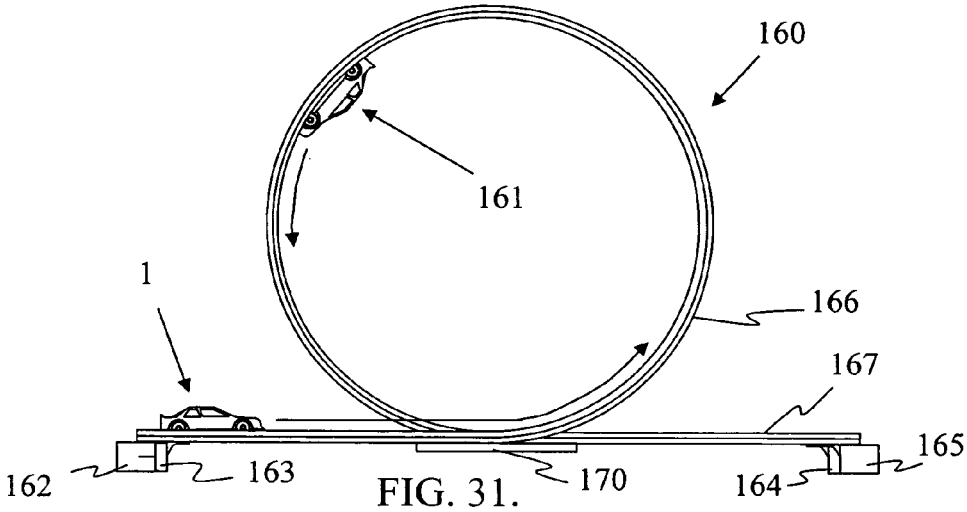
Figure 32:
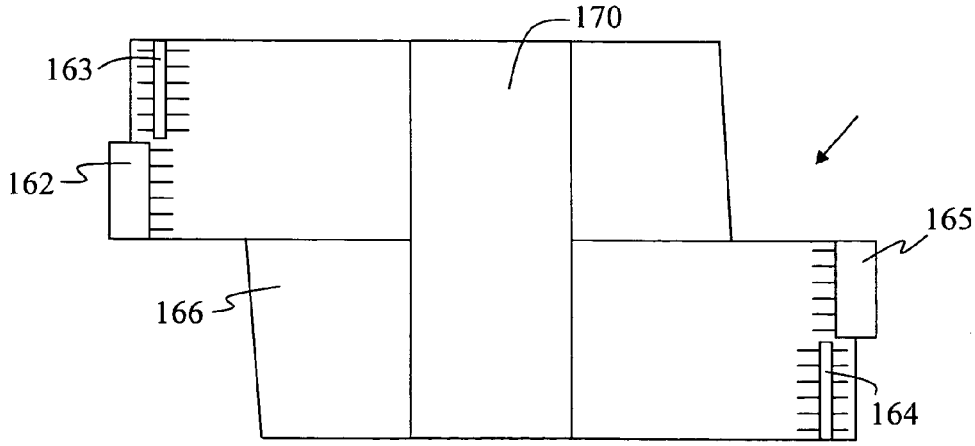

FIG. 31 is an elevation view of a PCB track configured as a loop section 160. It is shown in plan view in FIG. 30 and in bottom plan view in FIG. 32. The FR-4 piece 170 is fixed to the loop 166 to hold it in its looped form. The loop track section 160 will mate with the other user-configurable track sections as previously described.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A toy comprising an elongated track comprising a printed circuit board having electrically conductive traces, said track having multiple electrical conductors, each with segments comprised of said electrically conductive traces, said traces (1) alternately extending transversely across a desired path for a moveable object to be moved along said track and (2) being spaced from each other along the length of the track, said printed circuit board having multiple layers of said electrically conductive traces, wherein each of said multiple conductors conducts electrical current in a first direction along said path and transversely back and forth across said desired path a plurality of times, and then loops back to conduct said current along said desired path in a direction opposite said first direction and transversely across said desired path in the same direction as said current conducted in said first direction so that alternating groups of the segments of the same conductor that extend transversely across said desired path conduct current in the same transverse direction and thus produce electromagnetic fields having the same polarity, an electric power source supplying multiple phases of alternating current to said multiple conductors so that said conductor segments alternately extending transversely across said desired path sequentially produce alternating polarity electromagnetic fields extending above the surface of said track, along said desired path, while said power source is applied to said multiple conductors, each of said multiple phases being supplied to one of said conductors that includes traces located on a layer of said printed circuit board different from any layer having traces included in any other conductors supplied with any other phase, and said moveable object containing a permanent magnetic element whose magnetic field interacts with said alternating polarity electromagnetic fields to move said object along said desired path by magnetic attraction and repulsion when said object is placed in proximity to the surface of said track while said power source is applied to said multiple conductors.

2. The toy of claim 1 which includes an electrically conductive coil on said moveable object for interacting with said electromagnetic fields to induce an electrical current in said coil for powering electrical components on said moveable object.

3. The toy of claim 1 wherein said track comprises multiple printed circuit boards.

4. The toy of claim 1 wherein said track comprises multiple sections adapted to be connected to each other.

5. The toy of claim 1 wherein each of said conductor segments comprises multiple adjacent conductive traces of said printed circuit board, which collectively produce a common electromagnetic field around said multiple conductive traces.

6. The toy of claim 1 wherein said moveable object contains multiple magnetic elements.

7. The toy of claim 6 wherein said multiple magnetic elements comprise a Halbach array.

8. The toy of claim 1 wherein said power source is adapted to reversibly supply said electrical current to said conductors in an alternative sequence so that said object can be moved along said path in either direction.

9. The toy of claim 1 wherein at least portions of said track include conductive guardrails extending along the sides of said path, and said power source supplies power to said guardrails to produce electromagnetic fields around said guardrails to repel said object from said guardrails.

10. The toy of claim 1 wherein at least portions of said track are flexible to permit the formation of banked curves and loops.

* * * * *